US006823977B2

(12) United States Patent
Abe

(10) Patent No.: US 6,823,977 B2
(45) Date of Patent: Nov. 30, 2004

(54) COIN HOPPER WITH A SHUTTER

(75) Inventor: Hiroshi Abe, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 228 days.

(21) Appl. No.: 10/166,946

(22) Filed: Jun. 11, 2002

(65) Prior Publication Data

US 2002/0189919 A1 Dec. 19, 2002

(30) Foreign Application Priority Data

Jun. 13, 2001 (JP) ..... 2001-177933

(51) Int. Cl.[7] ..... G07F 1/00
(52) U.S. Cl. ..... 194/351
(58) Field of Search ..... 194/351, 200, 194/201, 202, 203, 204, 344, 349; 109/49.5

(56) References Cited

U.S. PATENT DOCUMENTS

| | | | | | |
|---|---|---|---|---|---|
| 3,371,762 | A | * | 3/1968 | Isaacson | 194/203 |
| 4,589,433 | A | | 5/1986 | Abe | 133/5 |
| 4,842,120 | A | * | 6/1989 | Dobbins et al. | 194/349 |
| 5,046,989 | A | * | 9/1991 | Dass | 453/17 |
| 5,402,871 | A | * | 4/1995 | Mercurio | 194/203 |
| 5,484,334 | A | * | 1/1996 | Evdokimo | 453/3 |
| 5,810,655 | A | | 9/1998 | Suzukawa et al. | 453/50 |
| 5,924,919 | A | | 7/1999 | Hirano | 453/57 |
| 6,059,651 | A | | 5/2000 | Abe et al. | 453/50 |
| 6,261,170 | B1 | | 7/2001 | Bell et al. | 453/57 |

FOREIGN PATENT DOCUMENTS

| | | | | |
|---|---|---|---|---|
| CH | 646.000 A5 | * | 10/1984 | G07F/3/02 |
| DE | 35.38.717 A1 | * | 5/1987 | G07F/1/02 |

* cited by examiner

*Primary Examiner*—Donald P. Walsh
*Assistant Examiner*—Mark J Beauchaine

(57) ABSTRACT

The present invention provides a coin dispensing apparatus for storing and dispensing coins through a dispensing slot that can be selectively controlled to prevent unauthorized access. A dispensing device dispenses coins through a coin passageway connected to a dispensing slot. A motor can activate the dispensing device to transport coins to the coin passageway which are in turn counted by a counting sensor unit. A control unit can provide signals for coordinating the operation of the motor and the activation of a shutting device for controlling access to the dispensing slot. A shutter can be spring biased and connected to a solenoid for automatically opening and closing the dispensing slot to prohibit intrusion of an exterior object into the coin passageway.

14 Claims, 8 Drawing Sheets

COIN HOPPER WITH A SHUTTER

BACKGROUND OF THE INVENTION

1. Field of the Invention

The present invention relates to a coin dispensing apparatus to protect against external interference, and more particularly, to a coin hopper apparatus with a shutter mechanism that can be automatically employed.

2. Description of Related Art

Various forms of coin hopper apparatuses have been utilized in vending machines, gaming machines, ticket vending machines, change dispensing machines, etc. The constant problem that has occurred is to safeguard the operation of the machine so that they can not be interfered with by a third party intruder. For example, in the gaming industry, dispensing apparatuses are frequently utilized at remote locations out of the sight of superintending employees, and attempts have been made to interfere with the operation of the machine and to cause the coin dispensing apparatus to properly dispense extra coins.

As shown in FIG. 6, a coin dispensing machine, such as a video game machine or a slot machine in a gaming environment, contains a coin hopper 101, a coin entry slot 103, and a discharge exit 104. The coin entry slot 103 can receive a coin D of the appropriate size or denomination. Attempts have been made to gain access to the coin stored in the coin hopper 101 by improperly interfering with the internal mechanisms by inserting objects into the interior of the gaming machine 100 through the discharge exit 102. An example of a coin dispensing machine can be seen in U.S. Pat. Nos. 4,589,433, 6,261,170, 5,924,919, and 5,810,655.

A problem has occurred in that an external object, such as a semi-rigid wire, can be inserted into the gaming machine from the discharge exit 102 to contact the dispensing slot of the hopper 101. If the wire is capable of reaching and moving a guiding roller, a sensor will detect the movement of an oscillating lever. When the game is then subsequently played, the control device of the gaming machine will distinguish only one signal, and as a result, the signal will be continued and not differentiated with a second signal, so that coins will be continually dispensed.

The prior art accordingly is seeking solutions to prevent the theft of coins from a coin hopper, and further to prevent damaging of internal mechanisms in a gaming machine.

SUMMARY OF THE INVENTION

The present invention addresses unauthorized intrusions into a coin dispensing apparatus with a relatively economical and compact structure which can be integrated into the manufacturing of a coin dispensing apparatus, or added as an improvement feature to coin dispensing apparatuses that are already in operation. The present invention can prohibit the intrusion of an object that can interfere with the coin passageway. When the coin dispensing apparatus of the present invention has completed its cycle of operation, the dispensing slot can be closed by a shutting device, and when the coin dispensing apparatus is to again be activated, the shutting device can then be removed. As can be appreciated, when coins are actually being dispensed from the coin hopper, an object cannot be inserted into the dispensing slot, because the discs that are being dispensed can become jammed.

The present invention can provide a coin dispensing apparatus that can both store and dispense coins through a dispensing slot. A dispensing device for dispensing coins through a coin passageway connected to the dispensing slot can be activated by a motor, while a counting sensor unit can be operatively connected to the coin passageway for counting the passage of coins. A shutting device can be operatively connected to the dispensing slot for opening and closing the dispensing slot to prohibit intrusion of an exterior object into the coin passageway. A control unit can provide appropriate enabling signals to coordinate the operation of the motor, the counting sensor unit, and the shutting device. The shutting device can include a closing member that can be movably mounted relative to the coin passageway through appropriately guiding alignment members to permit a selective blocking of the coin passageway. A biasing member can bias the closing member to block the coin passageway, and a drive member can be operatively connected to the closing member for moving the closing member relative to the coin passageway. The driving member can be a solenoid or other motive member.

DETAILED DESCRIPTION OF THE PREFERRED EMBODIMENTS

The present invention provides an improvement in coin hoppers or coin dispensing apparatuses to address the problems of theft by individuals interfering with the normal operation of the coin hopper. The terminology "coin" is used generically as understood in this field and does not only represent monetary coins of different denominations, but also medallions, game pieces, tokens, and other objects that can be stored in bulk, generally of a cylindrical configuration and released by a dispensing apparatus.

Figure 7:
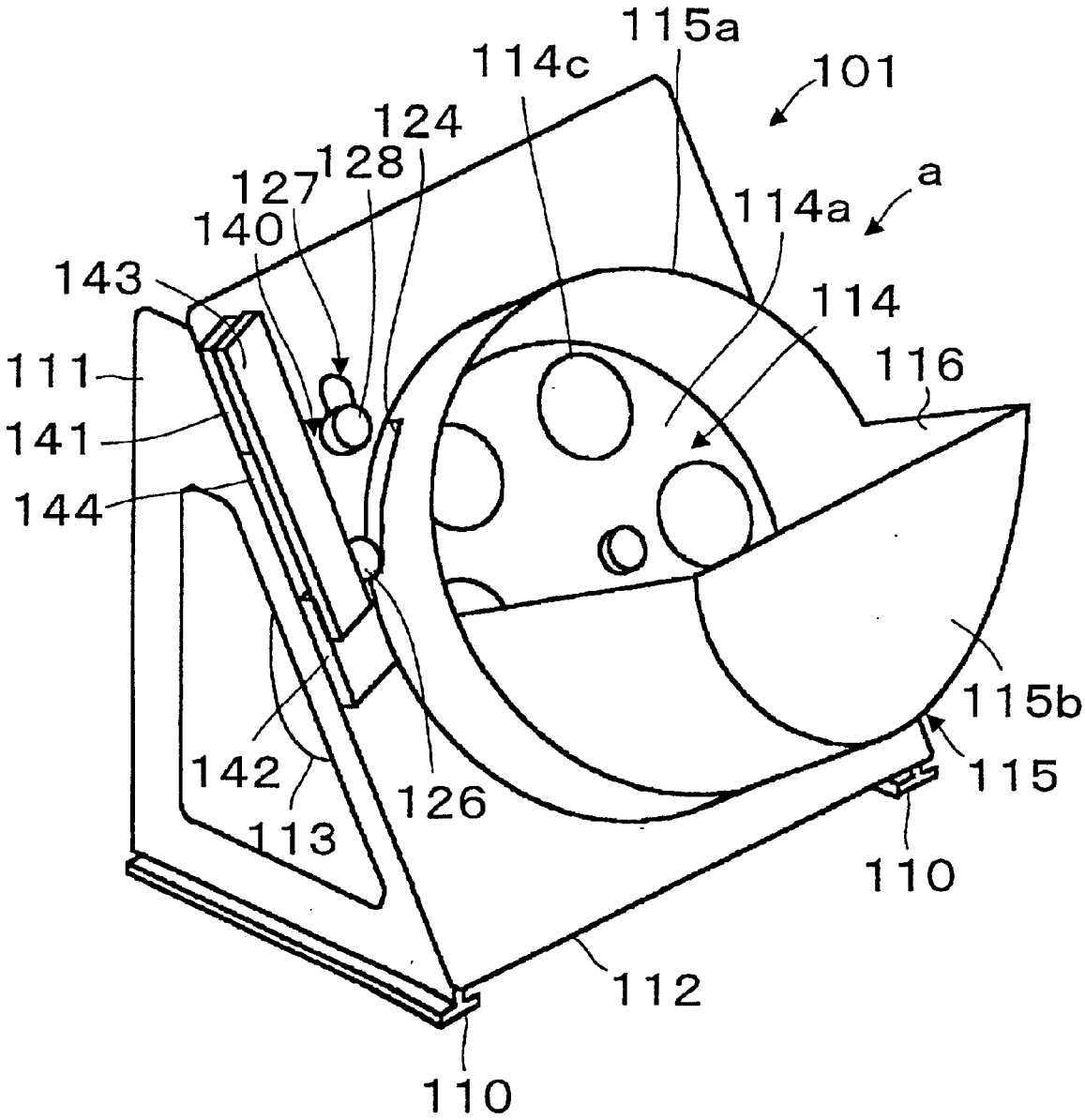
FIG. 7 is a front perspective view of a coin dispensing apparatus.
Figure 8:
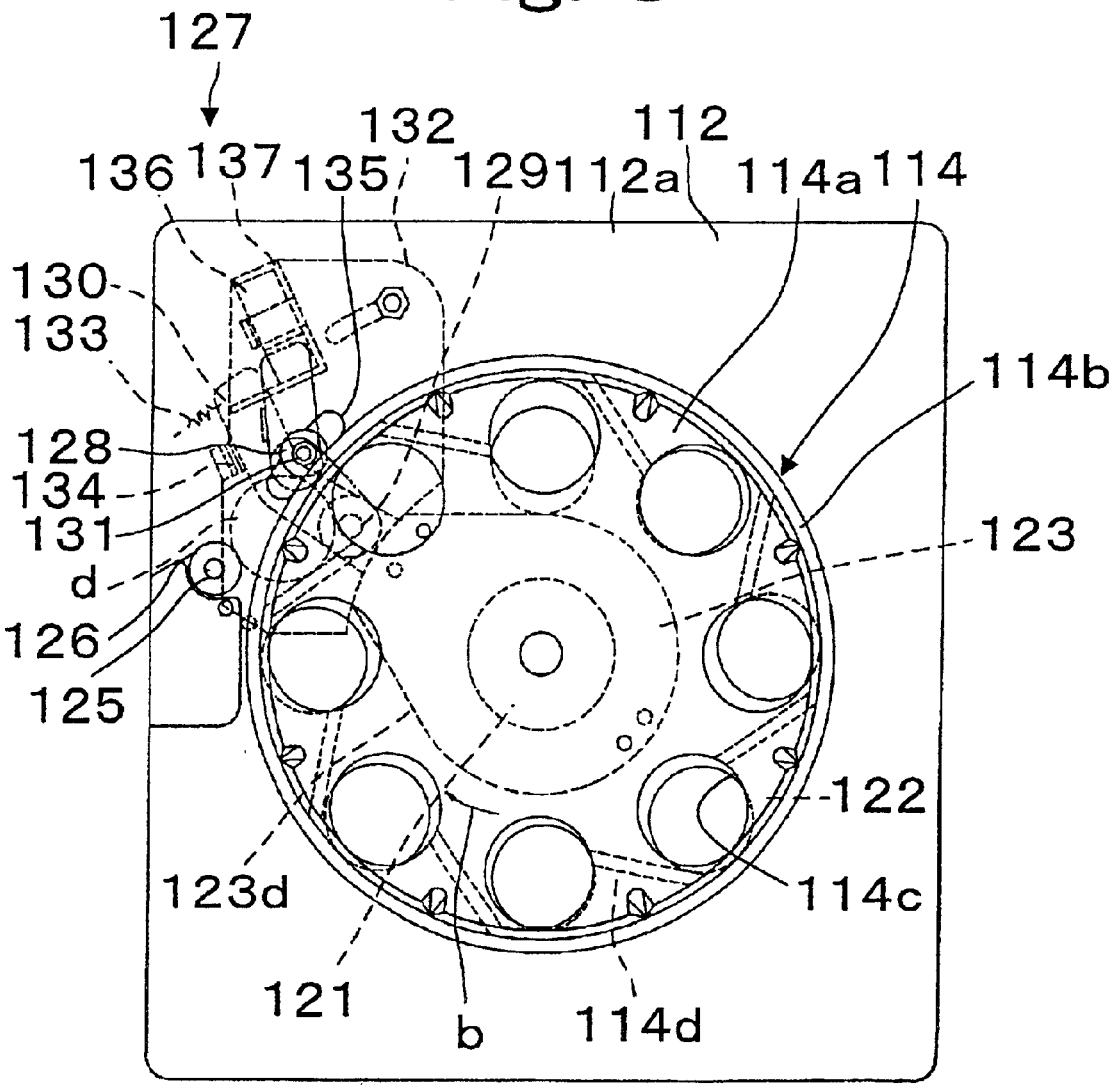
FIG. 8 is a diagram to explain an operation of a coin dispensing apparatus.

Referring to FIGS. 7 and 8, an example of a coin hopper, which can be modified with the present invention, is explained. Side frames 111 can be vertically fixed to a base 110, which can be installed within the gaming machine. A hopper supporting base plate 112 of a rectangular configuration can be fixed to the frame 111 to extend upward at a 60° angle. A motor 113 can be fixed on the reverse side of the hopper base 112 to drive a rotating coin dispensing member 114 through a reduction gear assembly (not shown). The rotation coin disc 114 can be located on the top surface of the hopper base 112 within a coin bowl 115 that is fixed to the hopper base 112. The coin bowl 115 can comprise an upper cylinder section 115*a* and a lower bucket section 115*b*, which is contained within the cylindrical section 115*a*. The bucket section 115*b* has an upper entry opening 116 for receiving bulk coins.

The coin dispensing device a can be further explained with reference to FIG. 8. The rotating disc 114 comprises a base board 114*a* and a surrounding wall member 114*b* which provide a cylinder-like configuration with the base. A plural number of holes 114*c* are of a dimension to pass through the disc d and are opened to the base board 114*a* with a similar radial spacing. A projection member 114*d* is located between each of the respective holes 114*c* and is slanted from a radial direction from the center of rotation of the rotating disc 114. The height of the projections 114*d* are smaller than the thickness of the individual disc d.

The coins, as they are lifted upward by the rotation of the rotating disc 114 provide a transporting area 122 which is formed on the upper surface 112*a* of the hopper base 112. The bottom surface of the holes 114*c* and spacer 121 are slightly thicker than the thickness of the disc d and have a ring-like configuration. As the rotating disc 114 revolves, the individual discs would become parallel to the rotating disc and will pass through the holes 112*c* that are located at the transporting area 122. These discs are then supported on the upper surface of the hopper base 112 and are moved by the projections 114*d*. A centrally located guiding board 123, which is somewhat oval in shape, is fixed around a spacer 121 on the hopper base 112. An exit guiding section 123*d* is located at the small end section of the oval guiding board 123 to direct coins to an exit 124 which has a configuration of a slit-like configuration or a slot and is formed at the cylindrical section 115*a* of the coin bowl adjacent the rotating disc 114. A fixed guide roller 126 pivots on a thick shaft 125 at the side exit 124.

As the coins are selected and directed towards the exit 124, a count sensor unit 127 is provided in the pathway of the coins to provide an appropriate count for the automatic dispensing of the coins. The count sensor unit 127 includes a movable guiding roller 128, an oscillating lever 130 which pivots on a thick shaft 129, and a sensor 136. The movable guiding roller 128 rotates on the shaft 131 in the middle of the oscillating lever 130. The shaft 131 is fixed at a bracket 132, which is in turn, attached to the reverse side of the hopper base 112.

The oscillating lever 130 moves in a counter-clockwise direction as a result of the force of a spring 133, which is hooked to the bracket 132. The oscillating lever 130 will be stopped by a stopper 134 shown in dotted lines on the oscillating lever 130 and penetrates through an arc elongated hole 135, which is formed on the hopper base 112. The moving guiding roller 128 can rotate on the end of the shaft 131.

The sensor unit 136 can be of an optical, magnetic or other type of sensor which can detect the oscillating lever 130 at a predetermined position and output a count signal.

As shown, the sensor unit 136 is fixed at the bracket 137, which in turn is fixed at a mounting bracket 132. A coin disk passageway 140 connects with a dispensing slot 144, which is rectangular-like in shape, and can be formed by the respective spacer members 141 and 142, which are both separately fixed on the hopper base 112 at the side of the exit 124. The moving guiding roller 128 is located adjacent to disc passageway 140.

Figure 6:
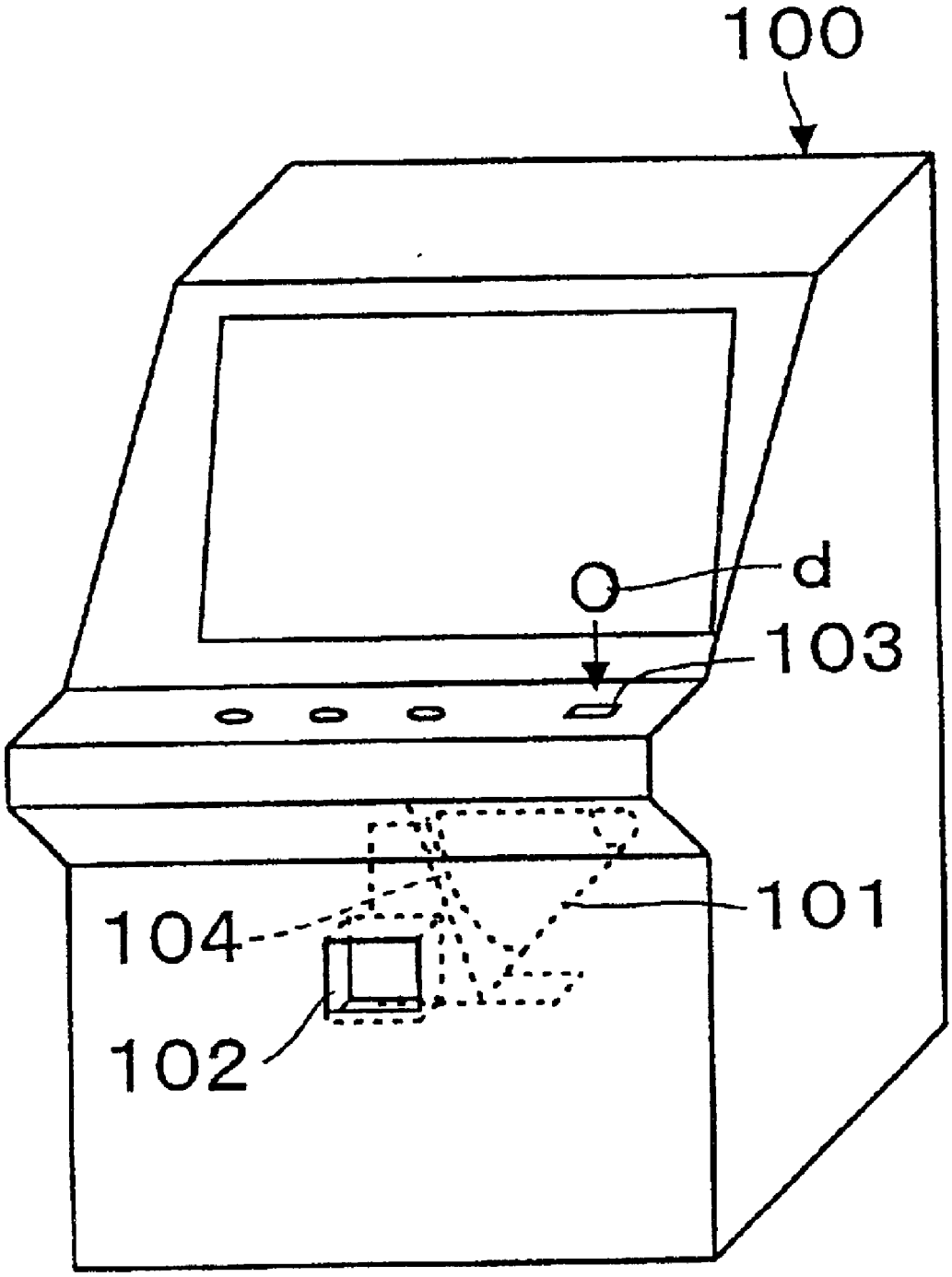
FIG. 6 is a prior art disclosure of a gaming machine.

A disc d can be entered into the gaming machine 100 when a player inserts the disc d in the coin entry 103 to play a game. The disc will be guided by a duct (not shown) in FIG. 6 to the coin bowl 115.

When the player wins at the game, a control device (not shown) of the gaming machine can output a payout signal of a certain predetermined number of discs d. When the hopper 101 is activated to fulfill the payout signal, the motor 113 will rotate to pickup individual coins. The rotating disc 114 is rotated in a clockwise direction and discs in the coin bowl 115 are then agitated by the rotating disc 114, and are positioned parallel for entrance into the various coin holes 114*c*. The coins are supported by the hopper base 112 and are pushed towards the arrow b by the projection 114*d*. When the disc d has contact with an exit guiding section 123*d*, it stops moving concentric with the center of rotation of the rotating disc 114 and is directed towards the exit 124. The force exerted by the projection 114*d* on the disc c, when in contact with the fixed guiding roller 126, causes the disc to contact the movable guiding roller 128 and to move it in a clockwise direction.

When the center of the disc d is located over a line which connects between the center of the fixed guiding roller 126 and the center of the movable guiding roller 128, the disc d is then expelled by the movable guiding roller 128 and is subsequently dispensed from the dispensing slot 144. Guiding ducts (not shown) will direct a disc to the discharge exit 102 in the gaming machine.

The oscillating bar 130 is moved in the clockwise direction by the movable guiding roller 128 and is detected by the sensor unit 136. The sensor unit 136 outputs a signal indicating the dispensing of one coin. The control device of the gaming machine, which can be a microprocessor-based control unit, can count the signals and can control the dispensing operation until the count number reaches a predetermined number whereupon the motor 113 can be stopped by the control device, and as a result, the dispensing of coins are stopped.

Figure 1:
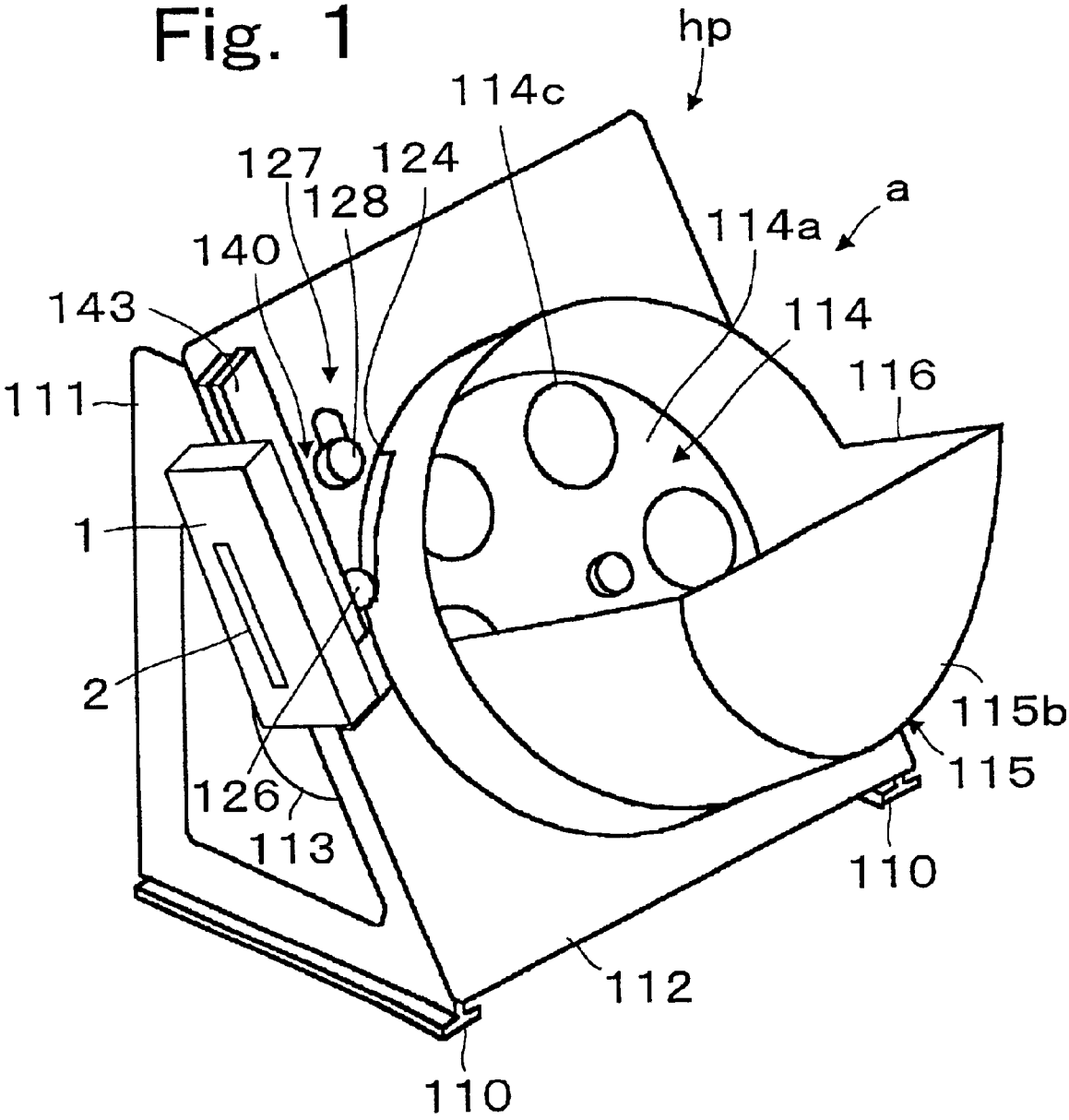
FIG. 1 is a perspective schematic view of a first embodiment of the present invention.
Figure 5:
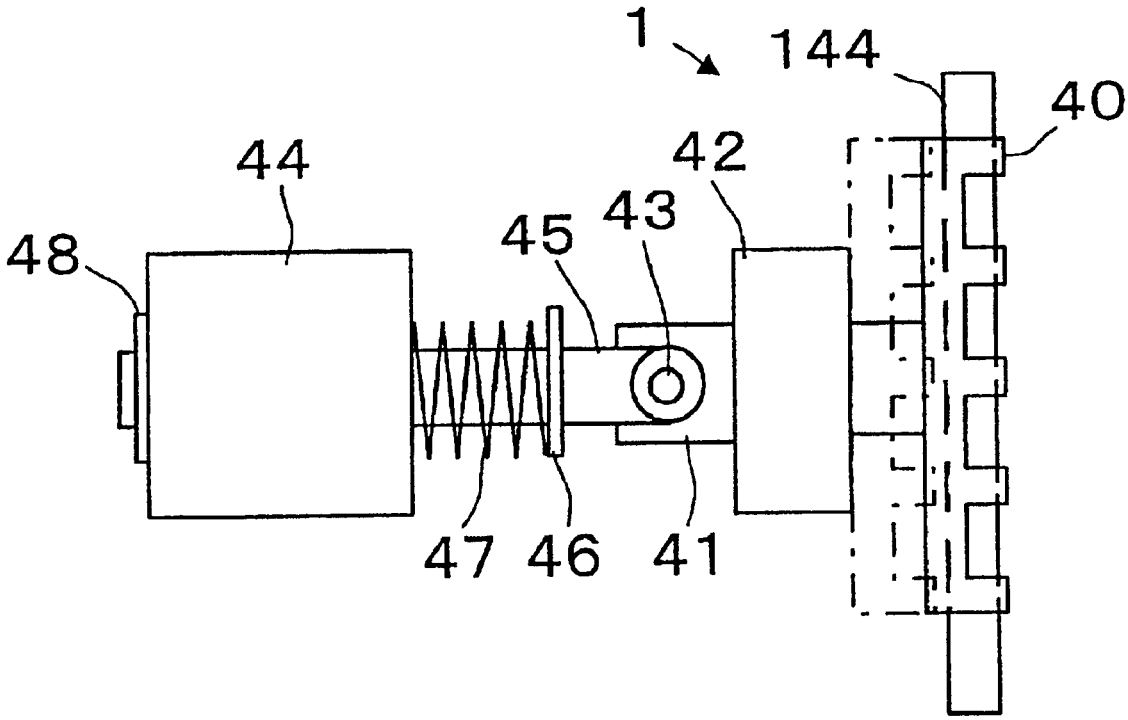
FIG. 5 is a schematic diagram of a second embodiment of the present invention.

Referring to FIG. 1, a coin hopper hp of the present invention can incorporate an automatic shutting device 1 which can be fixed at the hopper base 112 located near the dispensing slot 144. The shutting device or closure member 1 includes a second dispensing slot 2. The shutting device 1 can be retrofitted on existing coin dispensing apparatus or can be originally built into the coin dispensing apparatus as original equipment. As shown in FIG. 5, an alternative shutting device can be built near a dispensing slot 144. In the description of the present invention, the particular form of the coin dispenser or coin hopper that has been described for example with regards to FIGS. 7 and 8, will use the same reference numbers.

Figure 2:
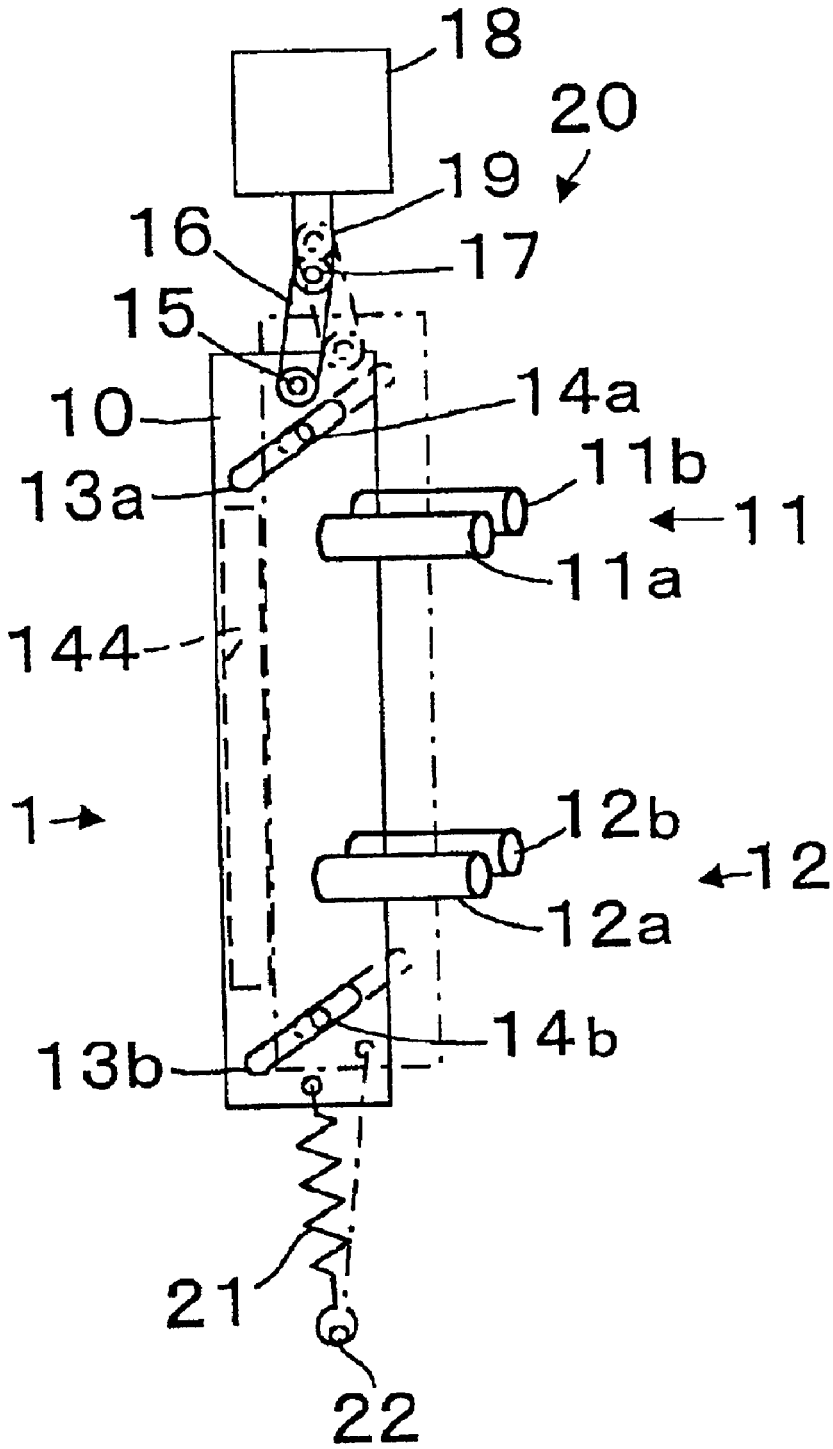
FIG. 2 is a schematic diagram of a shutting device of the first embodiment.

Referring to FIG. 2, the shutting device 1 can comprise a shutter 10 of an elongated rectangular plate configuration having a pair of angled elongated slots or holes 13*a* and 13*b*. The shutter 10 can be guided by a first guide unit 11 and a second guide unit 12. The respective guide units can be formed from bars or rails 11*a* and 11*b* and 12*a* and 12*b*, respectively. The shutter 10 is located between these bars and can be moved both up and down and to the left and right, as shown in FIG. 2, to either open or close the elongated dispensing slot 144. Pins 14*a* and 14*b* are respectively journaled within the first elongated hole 13*a* and the second elongated hole 13*b*. These pins control the relative movement of the shutter 10 as they cam along the surfaces of their respective elongated holes. A motive device 18, such as for example, a solenoid having a plunger or shaft 19, is connected through a linking arm 16 by a pin 15 located on the upper section of the shutter 10. Another pin 17 connects the upper section of the link 16 with the plunger core or shaft 19 to, for example, the solenoid 18.

As can be appreciated, other forms of motive power for providing movement to the shutter 10 could be utilized, such as a rack and pinion driven by a motor, etc.

At the lower end of the shutter 10, a spring 21 is utilized to bias the shutter 10 to close the elongated slot 144. In FIG. 2, the solid lines indicate the shutter 10 at a closed position.

If the solenoid 18 is excited, the shutter 10 can be pulled upward and to the right by engaging the pins 14*a* and 14*b* with the respective elongated slots 13*a* and 13*b*. The shutter 10 then moves away from the front of the dispensing slot 144, as shown by the dotted line in FIG. 2, to assume an open position. Thus, this particular arrangement is set forth to close the slot 144 with the shutter 10 when the solenoid 18 is not activated. Therefore, when the coin dispensing apparatus has not been engaged or put into operation, the shutter 10 will block access to the elongated slot 144. Since the shutter 10 is inserted in the gaming machine upstream from a coin discharge duct, any attempts to insert a foreign object, such as a wire, will be blocked by the shutter 10.

Figure 3:
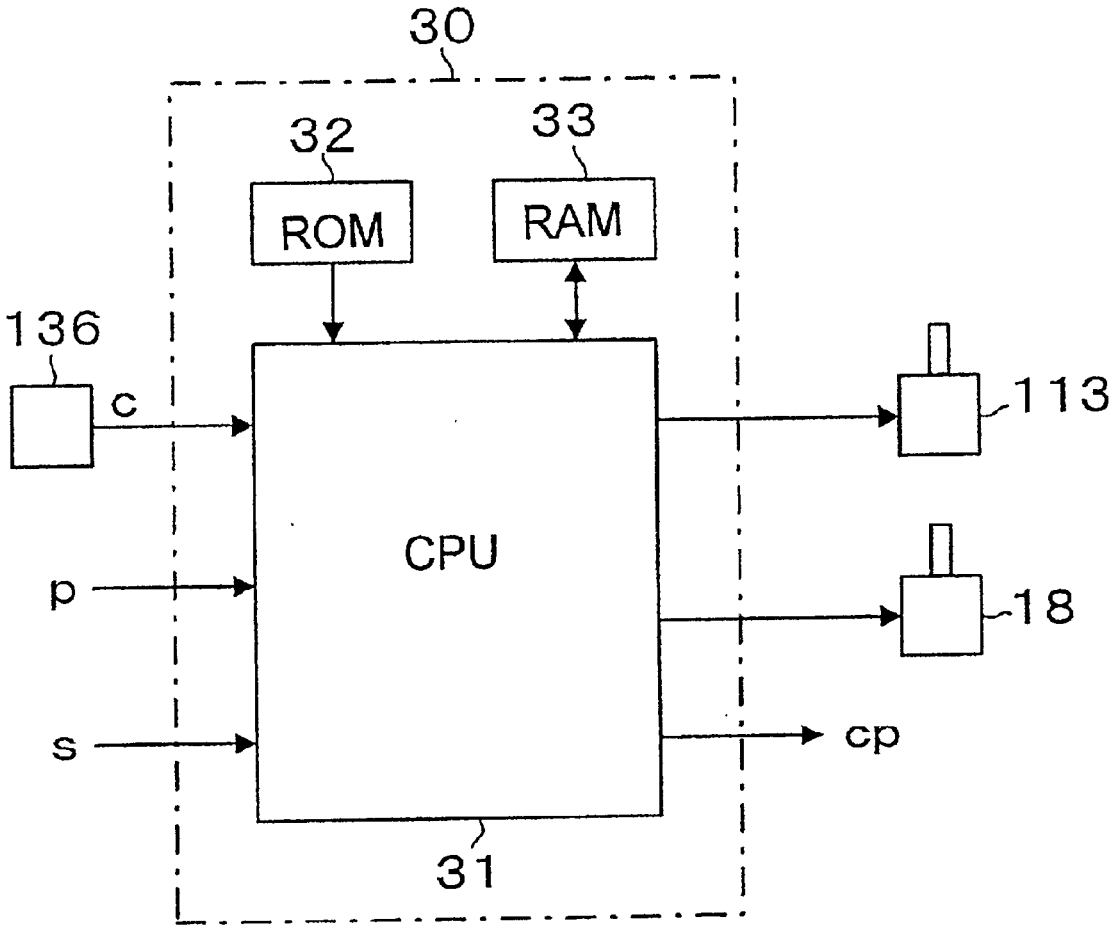
FIG. 3 is a block diagram of a control device of the first embodiment.

Referring to FIG. 3, a control unit 30 is disclosed in a schematic format. The control unit 30 can comprise a CPU 31, such as a microprocessor, a ROM 32, a RAM 34, and various I/O devices connected to ports or pins for the CPU 31. The CPU 31 can be operated by a program stored in the ROM 32 and can receive count signals c from a sensor 136. The count sensor 136 can be monitoring the discharge of coins from the coin hopper in response to the operation of, for example, a gaming machine or any other programmed operation of the coin dispensing apparatus for dispensing a fixed number of coins. A dispensing signal p can activate the control device 31, such as the depositing of a monetary coin into a vending machine to dispense change, the operation of a gaming program indicating a win for the user, or any other signal that will activate a dispensing of coins from a coin hopper. A stopping signal s can also be received from the gaming machine indicating, for example, the termination of the game activities.

Figure 4:
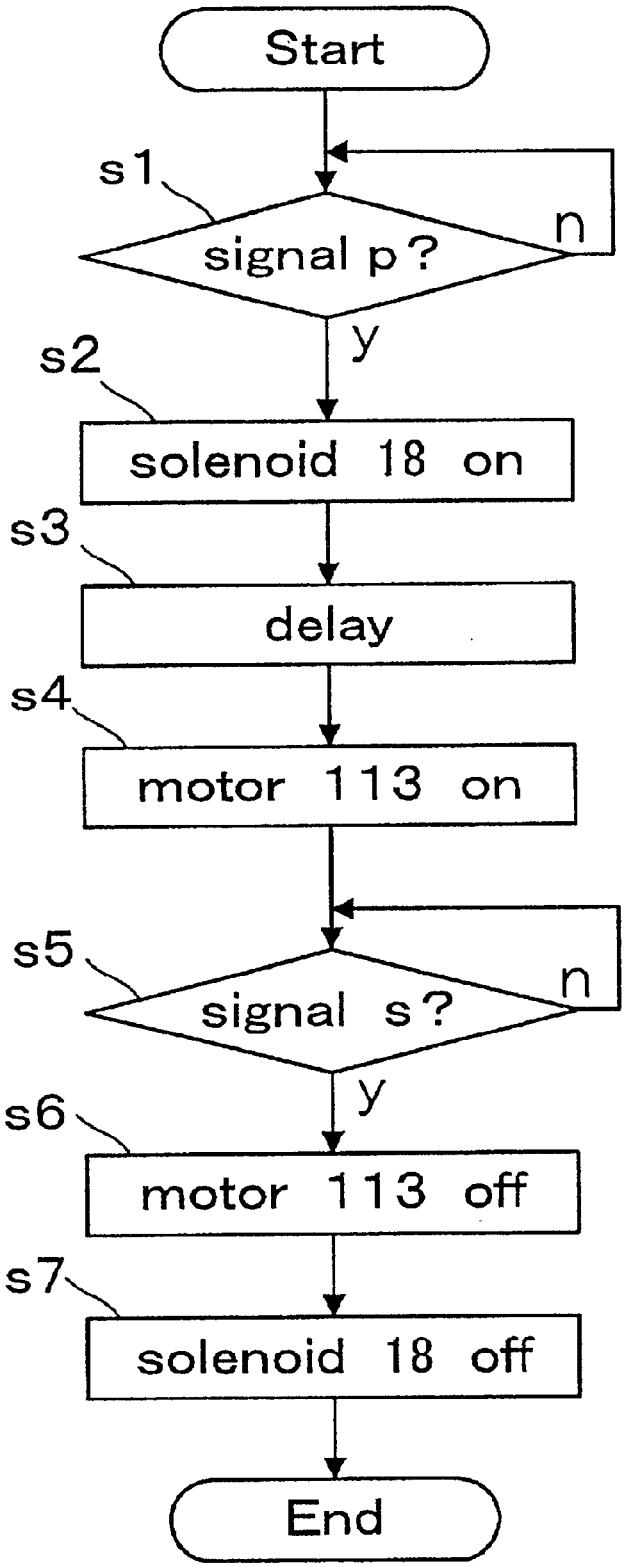
FIG. 4 is a flow chart for explaining the operation of the first embodiment.

The flowchart of FIG. 4 discloses the operation of the first embodiment of the present invention. When the hopper hp is inactive, that is, is not receiving any dispensing signal p from the control device of the game machine 100, the shutter 10 can be located at the closed position shown by the continuous line in FIG. 2. Shutter 10 is pulled to that position by the force of the spring 21. In this situation, if an illegal object is attempted to be inserted into the game machine through the discharge exit 102, the object is blocked from being inserted into the dispensing slot 144 of the hopper 101 by the shutter 10. As shown in step S1, a decision is made as to whether a signal p for dispensing coins has been received. If the decision is yes, the solenoid 18 is activated to an on state in step S2. The solenoid 18 will pull the shutter 10 up and towards the right as it is moved from the front of the dispensing slot 144 to open the slot. In step S3, a timer counts a predetermined time period to provide a delay before the motor 113 is activated in step S4. The motor 113 rotates the rotating disc 114 so the discs are pushed out from the dispensing passageway 124 one by one, to contact and move the guiding roller 128 so that they are capable of being counted. As a result, a disc d will pass through the dispensing slot 144 and be dispensed from the second dispensing slot 2. The oscillating lever 130, pivoted by the moving guiding roller 128, will cause the sensor unit 136 to detect movement of the oscillating lever 130 and output counting signals c.

The control device of the game machine will count the counting signal cp, which is output from the control device 30. When the control device 30 counts a predetermined number, e.g., the jackpot number of coins, it can then output a stopping signal s.

Step S5 is a decisional step to determine if the stopping signal has been activated. If there is no stopping signal, the coins will continue to be dispensed until the stopping signal is sensed. At step S6, the motor 113 will be turned off after the stopping signal s has been recognized, and then subsequently at step S7, the solenoid 18 will be turned off and the shutter mechanism will be pulled down by the spring 21 towards the left to close the dispensing slot 144.

In a modified embodiment, the control device 30 of the hopper hp can further count to the count signal c and can then output a stopping signal s.

A second embodiment of the present invention is disclosed in FIG. 5 and utilizes a shutter 40 that has a set of projecting paws or teeth to provide a comb-like shape. The handle of the shutter 41 is rectangular in shape, movable, and is inserted into a fixed guide 42.

The core 45 of a solenoid 44 pivots on pin 43 at the end of the handle 41. The core 45 will be pushed towards the right by the spring 47, which is located between the retainer 46 and the solenoid 44.

When the solenoid 44 is not excited, the core 45 will be moved towards the right as a result of the force of the spring 47. Retainer 48 on the core is stopped by the left side of the solenoid body 44. As a result, the shutter 40 is located at a closed position and substantially closes the dispensing slot 144.

When the solenoid 44 is excited, the core 45 is pulled towards the left and the shutter 40 moves in the same direction. As a result, shutter 40 moves away from the front of the dispensing slot 144 and is located at the opening position.

When the solenoid 44 is excited or unexcited by the control device 30, it is capable of performing the operations set forth in the description of the first embodiment.

Those skilled in the art will appreciate that various adaptations and modifications of the just described preferred embodiments can be configured without department from the scope and spirit of the invention. Therefore, it is to be understood that, within the scope of the appended claims, the invention may be practiced other than as specifically described herein.

What is claimed is:

1. A coin dispensing apparatus for storing and dispensing coins through a dispensing slot comprising;

a dispensing device for dispensing coins through a coin passageway connected to the dispensing slot;

a motor connected to the dispensing device for activating the dispensing device to transport coins to the coin passageway;

a counting sensor unit operatively connected to the coin passageway for counting the passage of coins;

a shutting device operatively connected to the dispensing slot for opening and closing the dispensing slot to prohibit intrusion of an exterior object into the coin passageway; and a control unit for providing signals to coordinate the operation of the motor and the shutting device.

2. The coin dispensing apparatus of claim 1 wherein the shutting device includes:

a closing member movably mounted relative to the coin passageway to permit a selective blocking of the coin passageway;

a biasing member biasing the closing member to block the coin passageway;

a drive member operatively connected to the closing member for moving the closing member relative to the coin passageway.

3. The coin dispensing apparatus of claim 2 wherein the drive member is a solenoid.

4. The coin dispensing apparatus of claim 2 wherein the biasing member is a spring.

5. The coin dispensing apparatus of claim 2 wherein the closing member is a flat plate.

6. The coin dispensing apparatus of claim 2 wherein the closing member is a plate with a plurality of cantilevered arms.

7. The coin dispensing apparatus of claim 1 wherein the control unit initially provides a first control signal to the shutting device to open the dispensing slot and then subsequently provides a second control signal to operate the motor.

8. The coin dispensing apparatus of claim 7 further including a coin sensor unit for counting the coins that are dispensed and the control unit provides a third control signal to the shutting device after completion of the dispensing of coins is determined to close the dispensing slot.

9. In a coin dispensing apparatus for storing and dispensing coins from a coin hopper to a coin passageway comprising;

a closing member movably mounted relative to the coin passageway to permit a selective blocking of the coin passageway to prevent an exterior intrusion of an object along the coin passageway;

a biasing member biasing the closing member to block the coin passageway;

a drive member operatively connected to the closing member for moving the closing member relative to the coin passageway; and a control unit for providing signals to coordinate the drive member for moving the closing member, wherein the control unit initially provides a first control signal to the drive member to open the coin passageway and then subsequently provides a second control signal to operate a motor for dispensing coins from the coin hopper.

10. The coin dispensing apparatus of claim 9 wherein the drive member is a solenoid.

11. The coin dispensing apparatus of claim 9 wherein the biasing member is a spring.

12. The coin dispensing apparatus of claim 9 wherein the closing member is a flat plate.

13. The coin dispensing apparatus of claim 9 wherein the closing member is a plate with a plurality of cantilevered arms.

14. The coin dispensing apparatus of claim 9 further including a coin sensor unit for counting the coins that are dispensed and the control unit provides a third control signal to the drive member after completion of the dispensing of coins is determined to close the coin passageway.

* * * * *